US010919299B1

(12) United States Patent
Praharaj

(10) Patent No.: US 10,919,299 B1
(45) Date of Patent: Feb. 16, 2021

(54) SYSTEM AND METHOD TO COUNTERACT THE DRYING OF AQUEOUS INKS IN A PRINTHEAD

(71) Applicant: Xerox Corporation, Norwalk, CT (US)

(72) Inventor: Seemit Praharaj, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 4 days.

(21) Appl. No.: 16/561,592

(22) Filed: Sep. 5, 2019

(51) Int. Cl.
*B41J 2/165* (2006.01)
*B41J 2/175* (2006.01)

(52) U.S. Cl.
CPC ..... *B41J 2/16511* (2013.01); *B41J 2/16505* (2013.01); *B41J 2/16523* (2013.01); *B41J 2/175* (2013.01); *B41J 2202/08* (2013.01); *B41J 2202/16* (2013.01)

(58) Field of Classification Search
CPC ..... B41J 2/16511; B41J 2202/08; B41J 1/16505; B41J 2/16523
See application file for complete search history.

(56) References Cited

U.S. PATENT DOCUMENTS

| | | | | |
|---|---|---|---|---|
| 4,296,418 | A | 10/1981 | Yamazaki et al. | |
| 4,364,065 | A | 12/1982 | Yamamori et al. | |
| 4,947,187 | A | 8/1990 | Iwagami | |
| 5,394,178 | A | 2/1995 | Grange | |
| 5,635,965 | A | 6/1997 | Purwins et al. | |
| 5,677,715 | A * | 10/1997 | Beck | B41J 2/16511 347/29 |
| 5,936,647 | A | 8/1999 | Rhodes et al. | |
| 5,980,622 | A | 11/1999 | Byers | |
| 7,156,514 | B2 | 1/2007 | Rosa | |
| 7,753,475 | B2 | 7/2010 | Berry et al. | |
| 7,992,986 | B2 | 8/2011 | Snyder et al. | |
| 8,592,503 | B2 | 11/2013 | Bogale et al. | |

(Continued)

FOREIGN PATENT DOCUMENTS

| | | |
|---|---|---|
| EP | 1 827 839 B1 | 2/2009 |
| KR | 10-1397307 B1 | 5/2014 |
| WO | 2008/026417 A1 | 1/2010 |

OTHER PUBLICATIONS

Kwon et al.; Measurement of inkjet first-drop behavior using a high-speed camera; Review of Scientific Instruments; Mar. 2, 2016; vol. 87—Issue No. 3; AIP Publishing.

*Primary Examiner* — Sharon Polk
(74) *Attorney, Agent, or Firm* — Maginot Moore & Beck LLP

(57) ABSTRACT

An inkjet printer is configured with capping stations for covering printheads during periods of printer inactivity. Each capping station has a printhead receptacle that encloses a volume, at least two members pivotably mounted to the printhead receptacle so the members can move between a first position where the members are adjacent a wall of the receptacle and a second position where the members extend across the volume of the printhead receptacle, and an actuator operatively connected to the pair of members to move the members between the first position and the second position. A thermoelectric device is mounted to each member. A controller is operatively connected to the actuator to operate the first actuator to move the members between the first position and the second position and to the thermoelectric devices to selectively apply an electrical current to the devices.

24 Claims, 8 Drawing Sheets

(56) References Cited

U.S. PATENT DOCUMENTS

| | | | | |
|---|---|---|---|---|
| 10,518,537 | B1 * | 12/2019 | Praharaj | B41J 2/16523 |
| 2003/0231222 | A1 | 12/2003 | Jefferson et al. | |
| 2008/0204501 | A1 | 8/2008 | Kurita et al. | |
| 2009/0237424 | A1 | 9/2009 | Martin et al. | |
| 2010/0073445 | A1 | 3/2010 | Silverbrook et al. | |
| 2013/0215189 | A1 | 8/2013 | Justice et al. | |

* cited by examiner

SYSTEM AND METHOD TO COUNTERACT THE DRYING OF AQUEOUS INKS IN A PRINTHEAD

TECHNICAL FIELD

This disclosure relates generally to devices that produce ink images on media, and more particularly, to devices that eject fast-drying ink from inkjets to form ink images.

BACKGROUND

Inkjet imaging devices eject liquid ink from printheads to form images on an image receiving surface. The printheads include a plurality of inkjets that are arranged in some type of array. Each inkjet has a thermal or piezoelectric actuator that is coupled to a printhead controller. The printhead controller generates firing signals that correspond to digital data for images. Actuators in the printheads respond to the firing signals by expanding into an ink chamber to eject ink drops onto an image receiving member and form an ink image that corresponds to the digital image used to generate the firing signals.

A prior art ink delivery system 20 used in inkjet imaging devices is shown in FIG. 8. The ink delivery system 20 includes an ink supply reservoir 604 that is connected to a printhead 608 and is positioned below the printhead so the ink level can be maintained at a predetermined distance D below the printhead to provide an adequate back pressure on the ink in the printhead. This back pressure helps ensure good ink drop ejecting performance. The ink reservoir is operatively connected to a source of ink (not shown) that keeps the ink at a level that maintains the distance D. The printhead 608 has a manifold that stores ink until an inkjet pulls ink from the manifold. The capacity of the printhead manifold is typically five times the capacity of all of the inkjets. The inlet of the manifold is connected to the ink reservoir 604 through a conduit 618 and a conduit 634 connects the outlet of the manifold to a waste ink tank 638. A valve 642 is installed in the conduit 634 to selectively block the conduit 634. A valve 612 is also provided in the conduit 614 connecting an air pressure pump 616 to the ink reservoir 604 and this valve remains open except during purging operations.

When a new printhead is installed or its manifold needs to be flushed to remove air in the conduit 618, a manifold purge is performed. In a manifold purge, the controller 80 operates the valve 642 to enable fluid to flow from the manifold outlet to the waste ink tank 638, activates the air pressure pump 616, and operates the valve 612 to close the ink reservoir to atmospheric pressure so pump 616 can pressurize the ink in the ink reservoir 604. The pressurized ink flows through conduit 618 to the manifold inlet of printhead 608. Because valve 642 is also opened, the pneumatic impedance to fluid flow from the manifold to the inkjets is greater than the pneumatic impedance through the manifold. Thus, ink flows from the manifold outlet to the waste tank. The pressure pump 616 is operated at a predetermined pressure for a predetermined period of time to push a volume of ink through the conduit 618 and the manifold of the printhead 608 that is sufficient to fill the conduit 618, the manifold in the printhead 608, and the conduit 634 without completely exhausting the supply of ink in the reservoir. The controller then operates the valve 642 to close the conduit 634 and operates the valve 612 to vent the ink reservoir to atmospheric pressure. Thus, a manifold purge fills the conduit 618 from the ink reservoir to the printhead, the manifold, and the conduit 634 so the manifold and the ink delivery system are primed since no air is present in the conduits or the printhead. The ink reservoir is then resupplied to bring the height of the ink to a level where the distance between the level in the reservoir and the printhead inkjets is D, as previously noted.

To prime the inkjets in the printhead 608 following a manifold prime, the controller 80 closes the valve 612 and activates the air pressure pump 616 to pressurize the head space of the reservoir 604 to send ink to the printhead. Because the valve 642 is closed, the pneumatic impedance of the primed system through the manifold is greater than the pneumatic impedance through the inkjets so ink is urged into the inkjets. Again, the purge pressure is exerted at a predetermined pressure for a predetermined period of time to urge a volume of ink into the printhead that is adequate to fill the inkjets. Any ink previously in the inkjets is emitted from the nozzles in the faceplate 624 of the printhead 608. This ink purging primes the inkjets and can also help restore clogged and inoperative inkjets to their operational status. After the exertion of the pressure, the controller 80 operates the valve 612 to open and release pressure from the ink reservoir. A pressure sensor 620 is also operatively connected to the pressure supply conduit 622 and this sensor generates a signal indicative of the pressure in the reservoir. This signal is provided to the controller 80 for regulating the operation of the air pressure pump. If the pressure in the reservoir during purging exceeds a predetermined threshold, then the controller 80 operates the valve 612 to release pressure. If the pressure in the reservoir drops below a predetermined threshold during purging, then the controller 80 operates the pressure source 616 to raise the pressure. The two predetermined thresholds are different so the controller can keep the pressure in the reservoir in a predetermined range during purging rather than at one particular pressure.

Some inkjet imaging devices use inks that change from a low viscosity state to a high viscosity state relatively quickly. In a prior art printer, a capping station, such as the station 60 shown in FIG. 9A, is used to cover a printhead when the printer is not in use. The cap is formed as a receptacle 704 to collect ink produced by the printhead 708 during a purge of the printhead. An actuator (not shown) is operated to move the printhead 708 into contact with an opening in the receptacle 704 as shown in FIG. 9B so the printhead can be purged to restore inkjets in the printhead by applying pressure to the ink manifold and passageways in the printhead. This pressure urges ink out of the nozzles in the faceplate of the printhead. This ink purging helps restore clogged and inoperative inkjets to their operational status. The ink purged from the printhead is directed to an exit chute 712 so the ink can reach a waste receptacle. The cap receptacle 704 also helps keep the ink in the nozzles from drying out because the printhead face is held within the enclosed space of the cap receptacle rather than being exposed to circulating ambient air.

For some quickly drying inks, however, the enclosed space of the cap is sufficient to enable the solvent, such as water, in the ink to evaporate from the ink. As the viscosity of the ink increases from this evaporation, the ink begins to adhere to the bores of the nozzles and the inkjets can become clogged even though the printhead is covered by the cap. Sometimes, the amount of ink that reaches a viscosity level can be more than a purge cycle can remove to restore the inkjet to operational status. Being able to reduce the number of inkjets that cannot be rehabilitated by purging after the printhead has been capped for a period of printhead inactivity would be beneficial.

SUMMARY

A method of inkjet printer operation enables ink at the nozzles of a printhead to maintain a low viscosity state. The method includes operating with a controller a first actuator operatively connected to at least two members pivotably mounted to at least one wall enclosing a volume to form a printhead receptacle to move the at least two members from a first position where the at least two members are adjacent the at least one wall of the printhead receptacle to a second position where the at least two members extend across the volume of the printhead receptacle, operating with the controller the first actuator to move the at least two members from the second position to the first position, and applying with the controller an electrical current to at least two thermoelectric devices mounted to the at least two members in a one-to-one correspondence when the at least two members are in the second position.

A capping station is configured to implement the method that enables ink at the nozzles of a printhead to maintain a low viscosity state. The capping station includes a printhead receptacle having at least one wall configured to enclose a volume, the printhead receptacle having an opening corresponding to a perimeter of a printhead, at least two members pivotably mounted to the at least one wall of the printhead receptacle, the members being configured to move between a first position where the members are adjacent the at least one wall of the printhead receptacle and a second position where the members extend across the volume of the printhead receptacle, at least two thermoelectric devices, a thermoelectric device is mounted to each member in the at least two members in a one-to-one correspondence, a first actuator operatively connected to the at least two members, the first actuator being configured to move the at least two members between the first position and the second position, and a controller operatively connected to the first actuator and the thermoelectric devices. The controller is configured to operate the first actuator to move the at least two members between the first position and the second position and to apply an electrical current to the thermoelectric devices selectively.

An inkjet printer includes the capping station to implement the method that enables ink at the nozzles of a printhead to maintain a low viscosity state. The printer includes a plurality of printheads and a capping station for each printhead in the plurality of printheads. Each capping station includes a printhead receptacle having at least one wall configured to enclose a volume, the printhead receptacle having an opening corresponding to a perimeter of the printhead associated with the capping station, at least two members pivotably mounted to the at least one wall of the printhead receptacle, the members being configured to move between a first position where the at least two members are adjacent of the at least one wall of the printhead receptacle and a second position where the at least two members extend across the volume of the printhead receptacle, at least two thermoelectric devices, the at least two thermoelectric devices are mounted to the at least two members in a one-to-one correspondence, a first actuator operatively connected to the at least two members, the first actuator being configured to move the at least two members between the first position and the second position, and a controller operatively connected to the first actuator of each capping station. The controller is configured to operate the first actuator of each capping station to move the at least two members between the first position and the second position and to apply an electrical current to the thermoelectric devices selectively.

BRIEF DESCRIPTION OF THE DRAWINGS

The foregoing aspects and other features of a system and method that enable ink at the nozzles of a printhead to maintain a low viscosity state are explained in the following description, taken in connection with the accompanying drawings.

DETAILED DESCRIPTION

Figure 1:
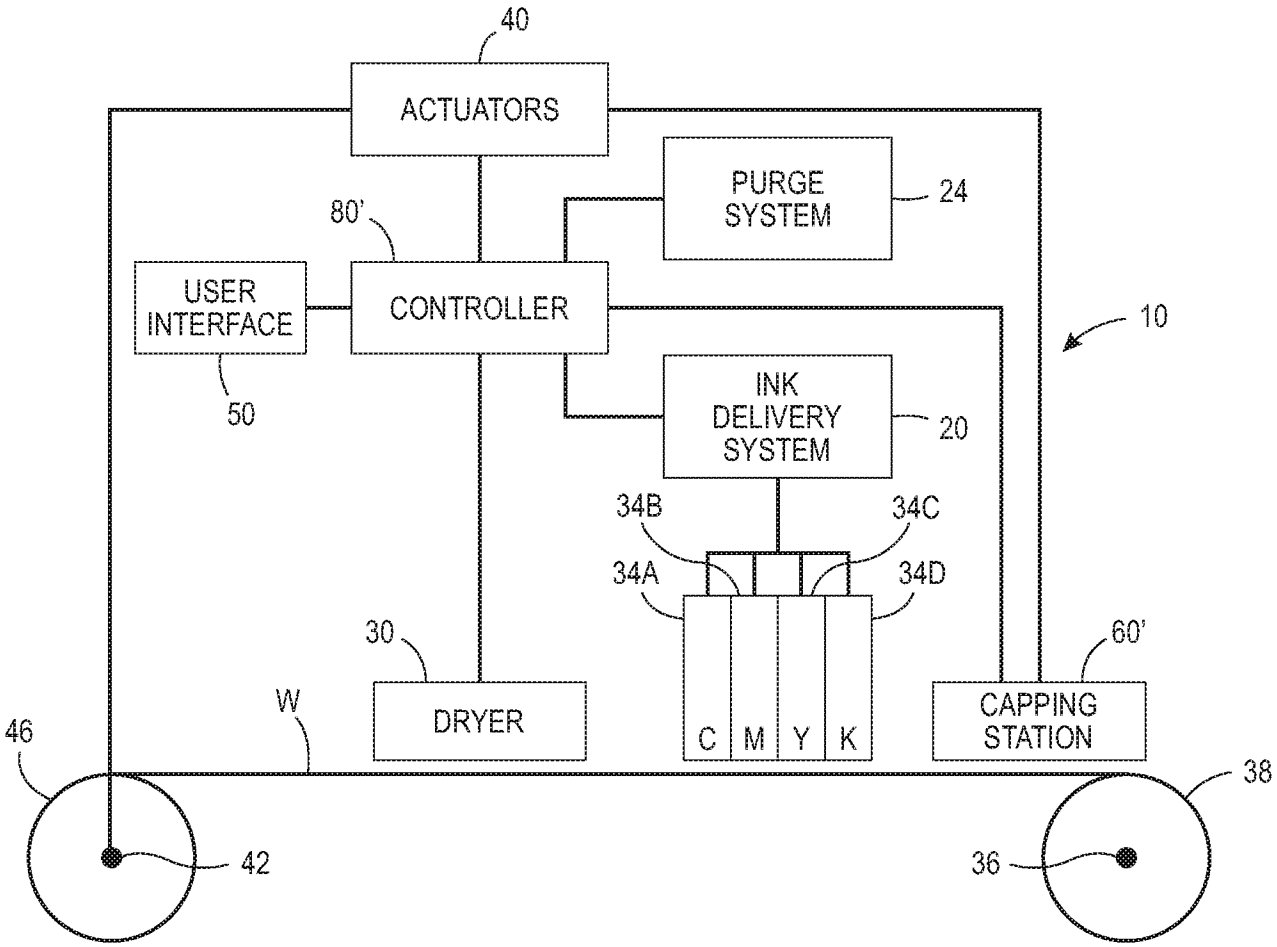
FIG. 1 is a schematic drawing of an aqueous inkjet printer that prints ink images directly to a web of media and that attenuates evaporation of fast drying inks from the printheads of the printer.

For a general understanding of the environment for the system and method disclosed herein as well as the details for the system and method, reference is made to the drawings. In the drawings, like reference numerals have been used throughout to designate like elements. As used herein, the word "printer" encompasses any apparatus that produces ink images on media, such as a digital copier, bookmaking machine, facsimile machine, a multi-function machine, or the like. As used herein, the term "process direction" refers to a direction of travel of an image receiving surface, such as an imaging drum or print media, and the term "cross-process direction" is a direction that is substantially perpendicular to the process direction along the surface of the image receiving surface. Also, the description presented below is directed to a system for operating inkjets in an inkjet printer to reduce evaporation of ink at the nozzles of the inkjets in the printer. The reader should also appreciate that the principles set forth in this description are applicable to similar imaging devices that generate images with pixels of marking material.

FIG. 1 illustrates a high-speed aqueous ink image producing machine or printer 10 in which a controller 80' has been configured to perform the process 400 described below to operate the capping system 60' so the ink at the nozzles of the printheads 34A, 34B, 34C, and 34D maintain a low viscosity state during periods of inactivity. As illustrated, the printer 10 is a printer that directly forms an ink image on a surface of a web W of media pulled through the printer 10 by the controller 80' operating one of the actuators 40 that is operatively connected to the shaft 42 to rotate the shaft and the take up roll 46 mounted about the shaft. In one embodiment, each printhead module has only one printhead that has a width that corresponds to a width of the widest media in the cross-process direction that can be printed by the printer. In other embodiments, the printhead modules have a plurality of printheads with each printhead having a width that is less than a width of the widest media in the cross-process direction that the printer can print. In these modules, the printheads are arranged in an array of staggered printheads that enables media wider than a single printhead to be printed. Additionally, the printheads can also be interlaced so the density of the drops ejected by the printheads in the cross-process direction can be greater than the smallest spacing between the inkjets in a printhead in the cross-process direction.

Figure 8:
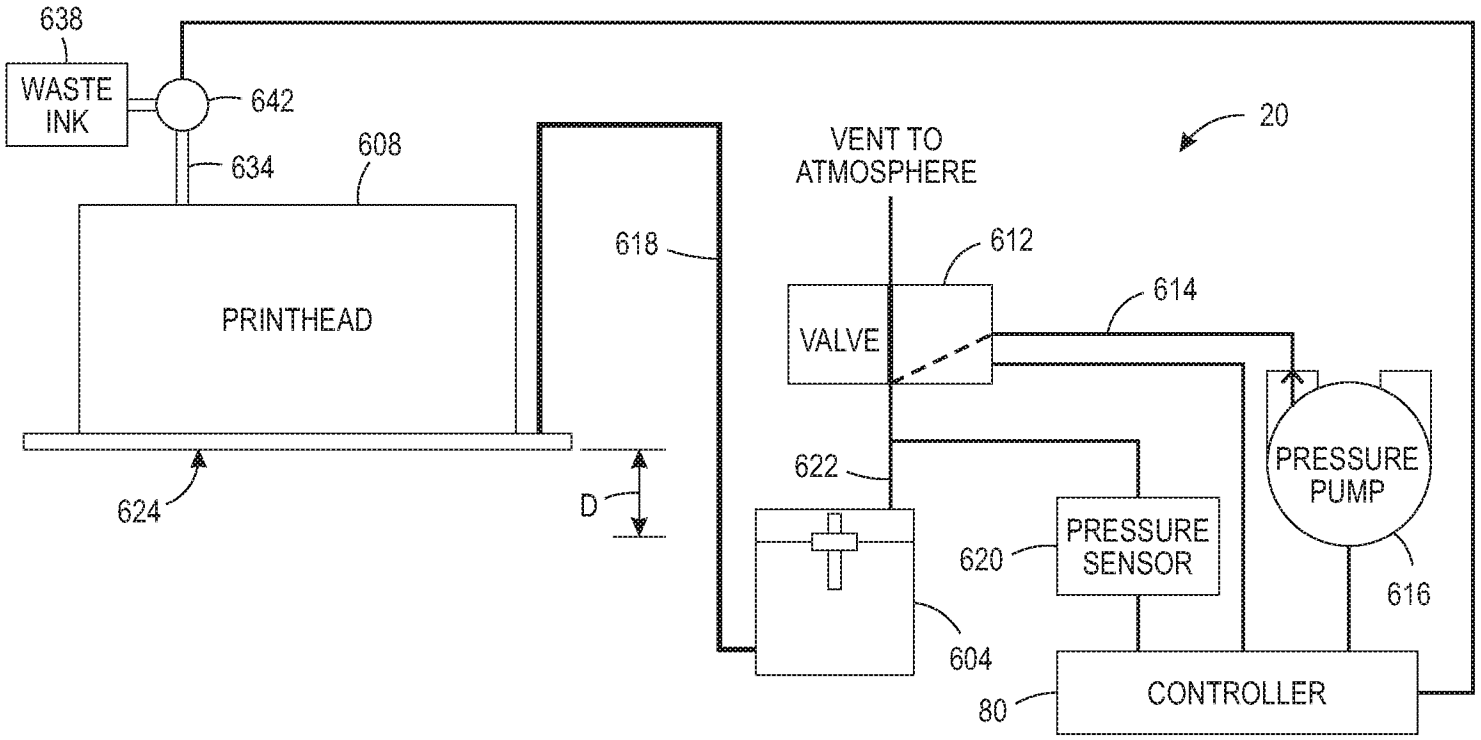
FIG. 8 PRIOR ART
FIG. 8 is a schematic diagram of a prior art ink delivery system that is used in prior art printers for purging only.

The aqueous ink delivery subsystem 20, such as the one shown in FIG. 8, has at least one ink reservoir containing one color of aqueous ink. Since the illustrated printer 10 is a multicolor image producing machine, the ink delivery system 20 includes four (4) ink reservoirs, representing four (4) different colors CYMK (cyan, yellow, magenta, black) of aqueous inks. Each ink reservoir is connected to the printhead or printheads in a printhead module to supply ink to the printheads in the module. Pressure sources and vents of the purge system 24 are also operatively connected between the ink reservoirs and the printheads within the printhead modules, as described above, to perform manifold and inkjet purges. Additionally, although not shown in FIG. 1, each printhead in a printhead module is connected to a corresponding waste ink tank with a valve as described previously with reference to FIG. 8 to enable the manifold and inkjet purge operations previously described. The printhead modules 34A-34D can include associated electronics for operation of the one or more printheads by the controller 80' although those connections are not shown to simplify the figure. Although the printer 10 includes four printhead modules 34A-34D, each of which has two arrays of printheads, alternative configurations include a different number of printhead modules or arrays within a module. The controller 80' also operates the capping system 60' and one or more actuators 40 that are operatively connected to components in the capping system 60' to preserve the low viscosity of the ink in the nozzles of the printheads in the printhead modules as described more fully below.

After an ink image is printed on the web W, the image passes under an image dryer 30. The image dryer 30 can include an infrared heater, a heated air blower, air returns, or combinations of these components to heat the ink image and at least partially fix an image to the web. An infrared heater applies infrared heat to the printed image on the surface of the web to evaporate water or solvent in the ink. The heated air blower directs heated air over the ink to supplement the evaporation of the water or solvent from the ink. The air is then collected and evacuated by air returns to reduce the interference of the air flow with other components in the printer.

As further shown, the media web W is unwound from a roll of media 38 as needed by the controller 80' operating one or more actuators 40 to rotate the shaft 42 on which the take up roll 46 is placed to pull the web from the media roll 38 as it rotates with the shaft 36. When the web is completely printed, the take-up roll can be removed from the shaft 42. Alternatively, the printed web can be directed to other processing stations (not shown) that perform tasks such as cutting, collating, binding, and stapling the media.

Operation and control of the various subsystems, components and functions of the machine or printer 10 are performed with the aid of a controller or electronic subsystem (ESS) 80'. The ESS or controller 80' is operably connected to the components of the ink delivery system 20', the purge system 24, the printhead modules 34A-34D (and thus the printheads), the actuators 40, the heater 30, and the capping station 60'. The ESS or controller 80', for example, is a self-contained, dedicated mini-computer having a central processor unit (CPU) with electronic data storage, and a display or user interface (UI) 50. The ESS or controller 80', for example, includes a sensor input and control circuit as well as a pixel placement and control circuit. In addition, the CPU reads, captures, prepares and manages the image data flow between image input sources, such as a scanning system or an online or a work station connection, and the printhead modules 34A-34D. As such, the ESS or controller 80' is the main multi-tasking processor for operating and controlling all of the other machine subsystems and functions, including the printing process.

The controller 80' can be implemented with general or specialized programmable processors that execute programmed instructions. The instructions and data required to perform the programmed functions can be stored in memory associated with the processors or controllers. The processors, their memories, and interface circuitry configure the controllers to perform the operations described below. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in very large scale integrated (VLSI) circuits. Also, the circuits described herein can be implemented with a combination of processors, ASICs, discrete components, or VLSI circuits.

In operation, image data for an image to be produced are sent to the controller 80' from either a scanning system or an online or work station connection for processing and generation of the printhead control signals output to the printhead modules 34A-34D. Additionally, the controller 80' determines and accepts related subsystem and component controls, for example, from operator inputs via the user interface 50, and accordingly executes such controls. As a result, aqueous ink for appropriate colors are delivered to the printhead modules 34A-34D. Additionally, pixel placement control is exercised relative to the surface of the web to form ink images corresponding to the image data, and the media can be wound on the take-up roll or otherwise processed.

Figure 2A:
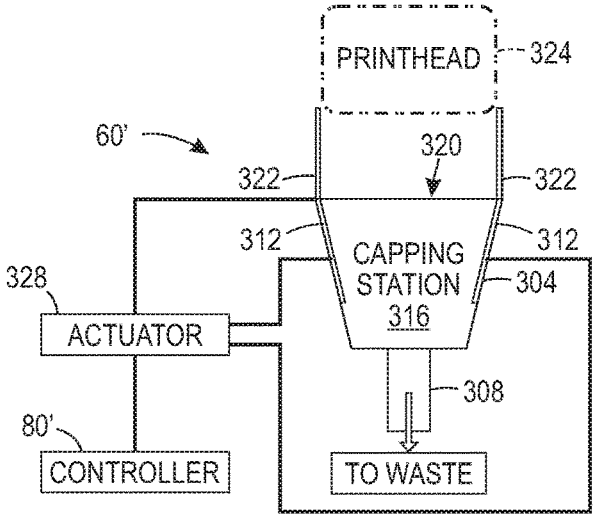
FIG. 2A and FIG. 2B are schematic diagrams of a printhead capping station that is used in the printer shown in FIG. 1 to attenuate the evaporation of fast drying inks from the printheads of the printer during periods of printhead inactivity.
Figure 2B:
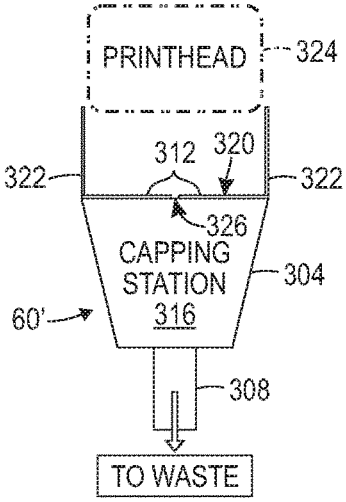
Figure 4A:
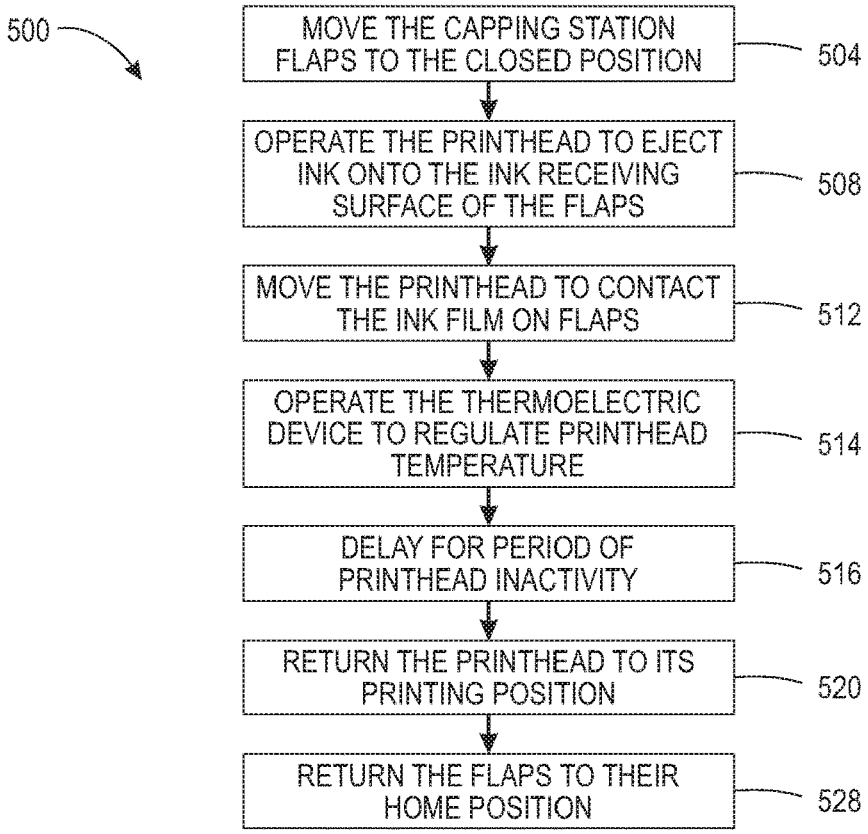
FIG. 4A is a flow diagram of a process for capping a printhead in the printer of FIG. 1 so evaporation of fast drying inks from the printheads of the printers is reduced and FIG. 4B is a flow diagram of a process for selecting which printheads are capped in printers where printheads are affected by varying lengths of printhead inactivity.
Figure 9A:
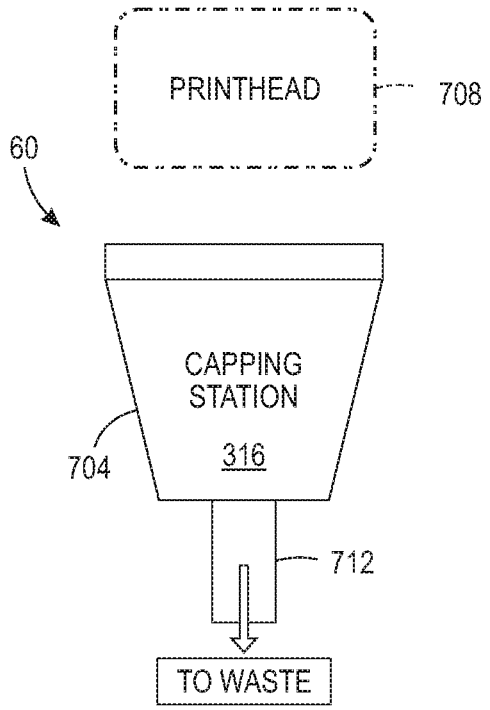
FIG. 9A PRIOR ART
FIG. 9A and FIG. 9B are schematic diagrams of a prior art capping station.
Figure 9B:
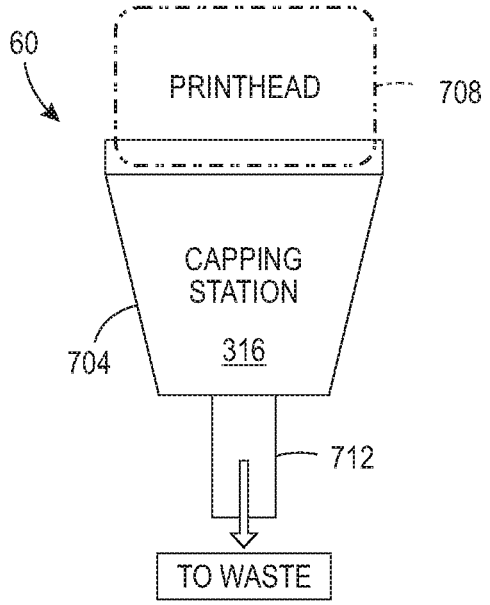
FIG. 9B PRIOR ART

Using like numbers for like components, a capping station that can attenuate the evaporation of quickly drying inks from printheads is shown in FIG. 2A and FIG. 2B. This system 60' differs from the one shown in FIG. 9A and FIG. 9B in that controller 80' is configured to perform the process 400 shown in FIG. 4A between print jobs or other periods of printhead inactivity to operate the capping station to reduce ink drying at the nozzles of the printhead supplied by the ink reservoir 604. FIG. 4A depicts a flow diagram for the process 400 that operates the capping system 60' to cover the faceplate of the printhead with an ink film to preserve the viscosity of the ink in the nozzle at its low viscosity. In the discussion below, a reference to the process 400 performing a function or action refers to the operation of a controller, such as controller 80', to execute stored program instructions to perform the function or action in association with other components in the printer. The process 400 is described as being performed with the capping station 60' in the printer 10 of FIG. 1 for illustrative purposes.

A capping station 60' that reduces the evaporation of ink during periods of printer inactivity is shown in FIGS. 2A and 2B. The capping station 60' includes a printhead receptacle 304, a discharge chute 308, and a pair of pivoting members or flaps 312 that move between a position in which the flaps are stored in the capping station and a position at which the flaps extend across the space within the capping station except for a small gap between the flaps. The printhead receptacle 304 has at least one wall 316 that encloses a volume of air. The opening 320 is shaped to correspond to the perimeter of the printhead 324. Sidewalls 322 extend from the edge of the opening 320 to enable the printhead 324 to slide between them and fit in the opening 320 for purging and storage operations. The flaps 312 are hinged with the wall 316 to enable the flaps to pivot toward the center of the space within the capping station and extend across the volume within the receptacle 304 as shown in FIG. 2B. The hinges about which the flaps 312 are mounted are configured to stop the pivoting of the flaps when the flaps extend perpendicularly from the wall 316 as shown in FIG. 2B. The flaps have a length so the ends of the flaps do not touch when the flaps extend across the space within the capping station. The gap 326 between the flaps 312 enables excess ink to fall into the printhead receptacle 304 as described below. One of the actuators 40 is operatively connected to both of the flaps 312 to pivot the flaps about the hinges to extend the flaps within the interior space of the capping station and to pivot the flaps to return the flaps to their storage position within the capping stations. The controller 80' of the printer 10 is operatively connected to one of the actuators 40 for operation of the actuator. FIG. 2A is the only figure showing the actuators and controller to simplify FIG. 2B.

Figure 3:
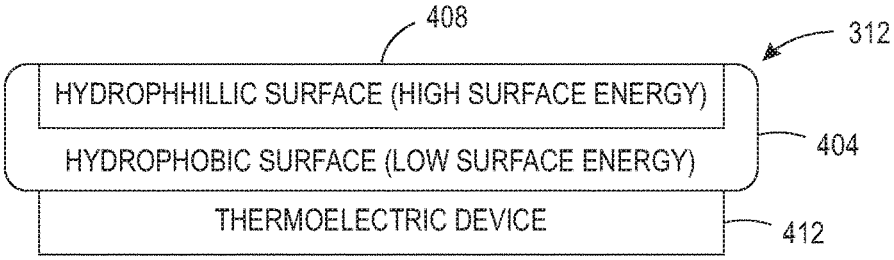
FIG. 3 depicts the structure of the flaps of the capping station shown in FIG. 2A and FIG. 2B.
Figure 6A:
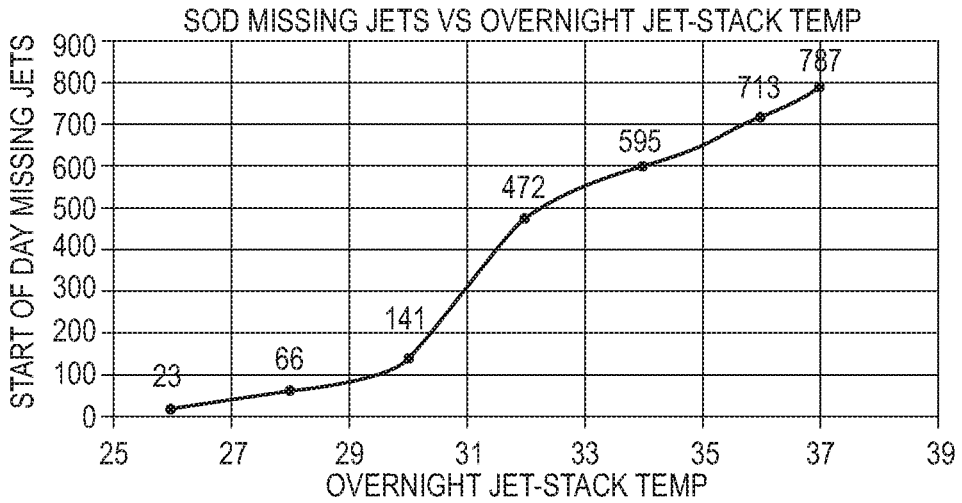
FIG. 6A and FIG. 6B are graphs showing the effect of printhead temperature on the number of inoperative inkjets in a printer after an overnight period of inactivity (FIG. 6A) and the mass of ink drops produced by the inkjets after the same overnight period of inactivity (FIG. 6B).
Figure 6B:
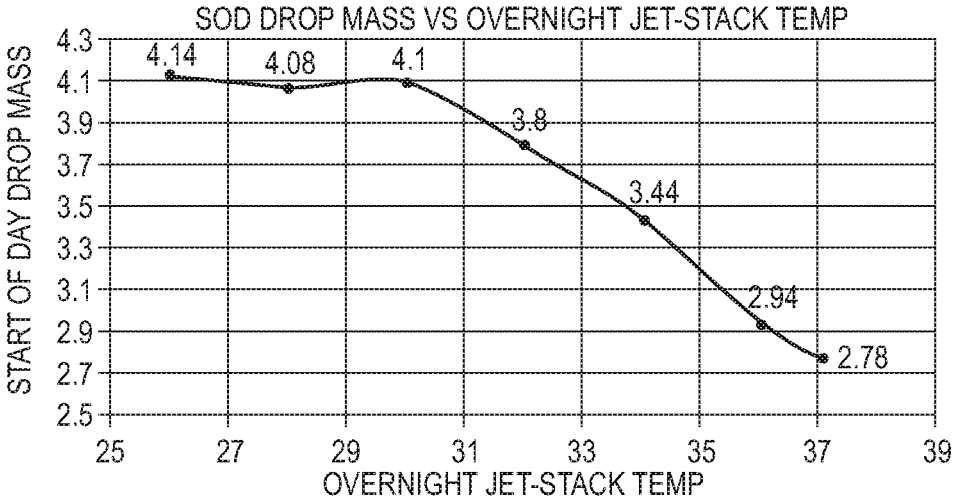

One embodiment of a flap 312 includes a base section 404 and an ink receiving surface 408 that are mounted to a thermoelectric device 412 as shown in FIG. 3. In an alternative embodiment, the ink receiving surface 408 can be mounted directly to the thermoelectric device 412 without any base section 404 intervening or included in the flap. As used in this document, the term "thermoelectric device" means a device having two layers of dissimilar materials that produce a heat flux at the junction between the two materials when an electrical current is applied across the two materials to move heat from one material to the other material. The ink receiving surface, which contacts ink received from the printhead 324 is made of hydrophilic material, which has a high surface energy, while the base section 404 is made of hydrophobic material, which has a low surface energy. These material choices ensure the ink from the printhead stays on the hydrophilic surface 408 to form a film having a uniform thickness. When the printhead is slowly moved toward the top of this film, a purge pressure is applied to the pressure chamber within the printhead so ink oozes from the nozzles onto the face of the printhead. As the printhead continues to move into contact with the top of this film, it squeezes the film so the ink is distributed across the face of the printhead and the air bubbles entrained in the resulting ink film escape the film. The pressure of the printhead when it rests on the surface 408 overcomes the surface tension forces in the ink to squeeze the ink from the center of the head. The controller 80' is operatively connected to the thermoelectric device 412 and selectively applies an electrical current across the thermoelectric device in a direction that removes heat from the other components in the flap and from the face of the printhead and directs the heat to the opposite side of the thermoelectric device. As shown by the graphs in FIG. 6A and FIG. 6B, maintaining the face of the printhead at a temperature below 31° C. has been found to help reduce the number of inoperative inkjets that are found in a printer and preserve the mass of the ink drops ejected by the operative inkjets when the printer is activated at the start of a day after a period of overnight inactivity. The maintenance of this printhead face temperature keeps the viscosity of the ink in the nozzles of the printhead at the lower end of its range. The presence of the ink on the hydrophilic surface 408 and the operation of the thermoelectric device 412 helps maintain the inkjets of the printhead in their operational state.

FIG. 4A depicts a flow diagram for a process 500 that operates the capping station 300 to prepare the ink receiving surfaces of the members 312 for storage of the printhead on the flaps. In the discussion below, a reference to the process 500 performing a function or action refers to the operation of a controller, such as controller 80', to execute stored program instructions to perform the function or action in association with other components in the printer. The process 500 is described as being performed for a capping station in the printer 10 of FIG. 1 for illustrative purposes.

Figure 5A:
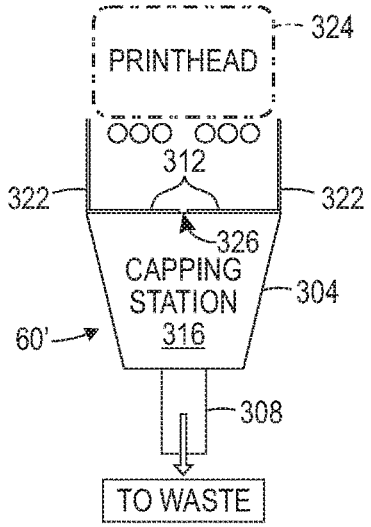
FIGS. 5A, 5B, and 5C illustrate the operation of the capping station during the process of FIG. 4A.
Figure 5B:
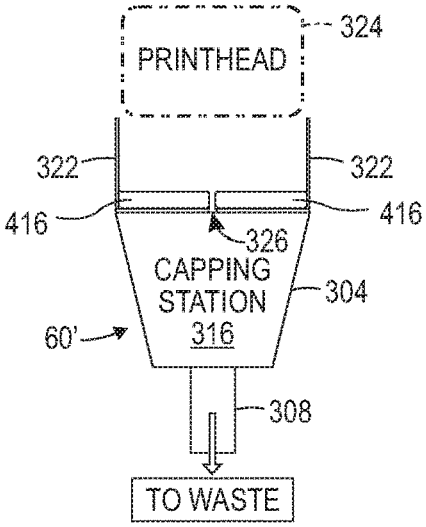
Figure 5C:
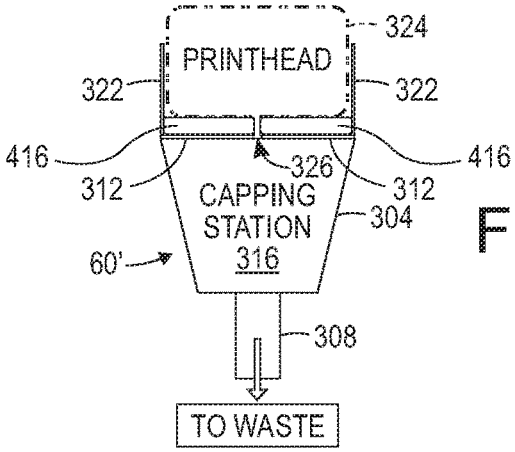

The process 500 of operating the capping station 60' is illustrated in FIG. 5A, FIG. 5B, and FIG. 5C. When a printhead is to be capped for a period of printer inactivity that can lead to inoperative inkjets, one of the actuators 40 is operated by the controller 80' to move the flaps to the position extending across the interior space of the capping station (block 504). The controller then operates the printhead to eject ink drops onto the ink receiving surface 408 of the flaps 312 (block 508). This processing is shown in FIG. 5A and FIG. 5B. As the ink forms a film 416 on the surfaces 408 of the flaps 312, the controller 80' operates another actuator in the actuators 40 to move the printhead 324 toward the flaps 312 (block 512). This portion of the operation is shown in FIG. 5C. The actuator moves the printhead at a speed that enables the printhead to squeeze out air bubbles that may be entrained in the ink film 416. In one embodiment, this speed is in a range of about 0.03 inches/second to about 0.07 inches/second, although the speed is dependent upon factors such as the viscosity of the ink and the size of the ink receiving surface of the flaps, for example. The controller continues to operate the actuator until the printhead rests on the ink film 416 on the ink receiving surfaces 408 of the flaps 312 as shown in FIG. 5C. The controller then operates the thermoelectric device to bring the temperature of the face of the printhead below a predetermined threshold (block 514). The operation of the thermoelectric device can be conducted by operating the device for predetermined periods of time that are separated by a predetermined interval of time. Alternatively, a temperature sensor can be positioned in the base 404 at the interface of the ink receiving surface 408 and the face of the printhead. The controller can monitor the signal generated by the temperature sensor and use closed loop control to operate the thermoelectric device so the temperature at the face of the printhead is maintained within a predetermined range. The printhead remains at this position for some period of inactivity (block 516) and then the controller operates the actuator 328 connected to the printhead to return the printhead to its printing position (block 520). The controller also reverses the operation of the actuator 328 connected to the flaps 312 to retract the flaps within the capping station (block 524). The ink receiving surfaces 408 do not need to be cleaned because the ejection of fresh ink drops on them at the start of another iteration of the process 500 rehydrates the dried ink so the ink film layer can be formed.

The capping station 60' and its operation for printhead storage enable the ink at the nozzles of a printhead to remain immersed with liquid ink on the ink receiving surfaces 408 so the ink in the nozzles does not evaporate or significantly change in viscosity. Additionally, the operation of the thermoelectric device helps maintain the temperature of the face of the printhead within a range that aids in keeping the ink at the nozzles of the printhead at the lower end of its viscosity range. Thus, the printhead is not likely to need purging after its storage in the capping station for periods of printer inactivity and ink is saved for printing. A printer, such as printer 10, can be configured with a capping station 60' for each printhead in each printhead module 34A, 34B, 34C, and 34D. The controller 80' can be operatively connected to the actuators in each capping station and the controller 80' is configured to operate the actuators to perform the process shown in FIG. 4A for the storage of the printheads in the printer.

Figure 4B:
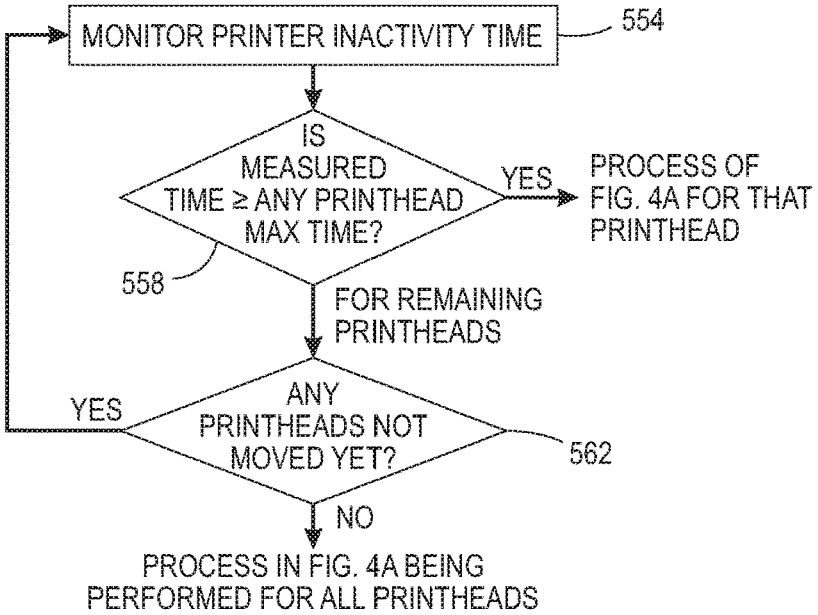

The process shown in FIG. 4B is used in the process of FIG. 4A in printers in which the length of printer inactivity time that affects the viscosity of ink in the nozzles adversely varies from printhead to printhead. Most commonly, this difference arises from the type of ink used in the printhead. In some aqueous inkjet printers, magenta ink has been observed as being particularly susceptible to reaching a higher viscosity that adversely affects the inkjets before other inks. In the process of FIG. 4B, a timer measuring printer inactivity time is monitored (block 554) and compared to a predetermined time limit for each printhead in the printer (block 558). When the monitored time is equal to or greater than the predetermined time limit for a printhead, the process of FIG. 4A is performed for that printhead. The process then checks to see if any printheads have not been moved to its corresponding capping station (block 562), and if any remain, then the time of inactivity continues to be monitored and compared to the time limit for that printhead (block 558). This process continues until all of the printheads are moved to a capping station or the printer returns to operational status.

Figure 7A:
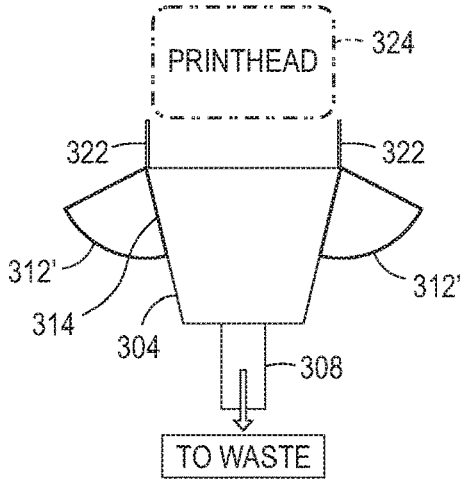
FIG. 7A, FIG. 7B, and FIG. 7C illustrate the operation of an alternative embodiment of the printhead capping station shown in FIG. 2.
Figure 7B:
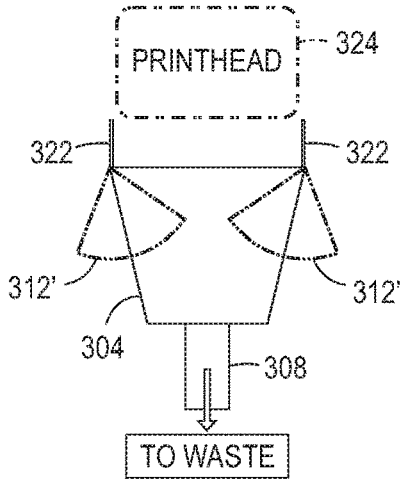
Figure 7C:
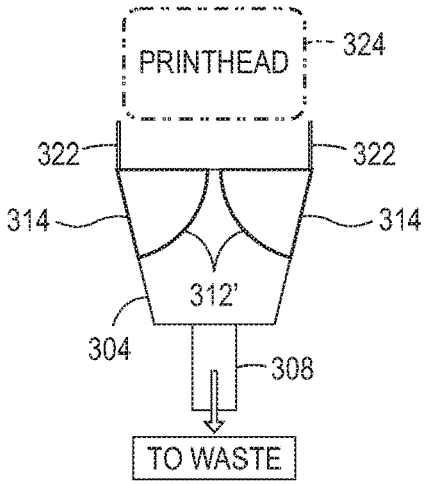

Using like numbers for like components, an alternative embodiment of the capping station that can attenuate the evaporation of quickly drying inks from printheads is shown in FIGS. 7A, 7B, and 7C. The receptacle 304 has slots 314 in its sidewall to enable flaps 312' to rotate through the sidewall. The flaps 312' are operatively connected to actuators 40 and to controller 80' so the controller can operate the actuator to rotate the flaps 312' through the range of motion shown in the figures and then back to the starting position shown in FIG. 7A. The flaps 312' are shaped as sectors of a circle. The surface of the flaps 312' have the structure shown in FIG. 3 or the alternative embodiment noted above that does not include the base section 404. These sector shaped flaps help provide support against the face of the printhead when the flaps are in the position shown in FIG. 7C. As used in this document, the term "sector-shaped" means a shape form by two lines from the center of a circle to the circumference of the circle that is subtended by the circumference between the two lines from the center.

It will be appreciated that variants of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A capping station useful for storing printheads during periods of inactivity comprising:

a printhead receptacle having at least one wall configured to enclose a volume, the printhead receptacle having an opening corresponding to a perimeter of a printhead;

at least two members pivotably mounted to the at least one wall of the printhead receptacle, the members being configured to move between a first position where the members are adjacent the at least one wall of the printhead receptacle and a second position where the members extend across the volume of the printhead receptacle;

at least two thermoelectric devices, a thermoelectric device is mounted to each member in the at least two members in a one-to-one correspondence;

a first actuator operatively connected to the at least two members, the first actuator being configured to move the at least two members between the first position and the second position; and a controller operatively connected to the first actuator and the thermoelectric devices, the controller being configured to operate the first actuator to move the at least two members between the first position and the second position and to apply an electrical current to the thermoelectric devices selectively.

2. The capping station of claim 1, each member in the at least two members further comprising:

a base section mounted to the thermoelectric device of the member; and an ink receiving surface mounted to the base section.

3. The capping station of claim 2 wherein the base section is made of hydrophobic material and the ink receiving surface is made of hydrophilic material.

4. The capping station of claim 3 wherein the members of the at least two members extend perpendicularly from the at least one wall to extend across the volume of the printhead receptacle when the at least two members are at the second position.

5. The capping station of claim 4 wherein each member of the at least two members have a same length.

6. The capping station of claim 5 wherein the length of each member does not enable the at least two members to contact one another when the at least two members are at the second position to form a gap between the at least two members at a center of the opening of the printhead receptacle.

7. The capping station of claim 6 wherein each member is a sector-shaped member.

8. The capping station of claim 7, the printhead receptacle further comprising:

a discharge chute for ink received in the printhead receptacle.

9. The capping station of claim 8 further comprising:

a second actuator operatively connected to a printhead; and the controller is operatively connected to the second actuator, the controller being further configured to operate the second actuator to move a face of the printhead into contact with the ink receiving surface of the at least two members when the at least two members are at the second position.

10. The capping station of claim 9 wherein the controller is further configured to operate the printhead to eject drops of ink onto the ink receiving surfaces of the at least two members when the at least two members are at the second position.

11. The capping station of claim 10 wherein the controller is further configured to operate the second actuator to move the printhead at a speed that squeezes air bubbles entrained in the ink ejected onto the ink receiving surfaces of the at least two members at the second position.

12. A method of operating a capping station for storing a printhead during a period of printer activity comprising:

operating with a controller a first actuator operatively connected to at least two members pivotably mounted to at least one wall enclosing a volume to form a printhead receptacle to move the at least two members from a first position where the at least two members are adjacent the at least one wall of the printhead receptacle to a second position where the at least two members extend across the volume of the printhead receptacle;

operating with the controller the first actuator to move the at least two members from the second position to the first position; and applying with the controller an electrical current to at least two thermoelectric devices mounted to the at least two members in a one-to-one correspondence when the at least two members are in the second position.

13. The capping station of claim 1, each member in the at least two members further comprising:

an ink receiving surface mounted to the thermoelectric device of the member.

14. The method of claim 12 further comprising:

operating with the controller a second actuator operatively connected to a printhead to move a face of the printhead into contact with an ink receiving surface of each member when the at least two members are at the second position.

15. The method of claim 14 further comprising:

operating with the controller the printhead to eject drops of ink onto the ink receiving surfaces of the at least two members when the members are at the second position.

16. The method of claim 15 further comprising:

operating with the controller the second actuator to move the printhead at a speed that squeezes air bubbles entrained in the ink ejected onto the ink receiving surfaces of the at least two members at the second position.

17. The method of claim 16 further comprising:

measuring a time of inactivity for each printhead in a printer, each printhead having a corresponding printhead receptacle in the printer;

comparing the measured time of inactivity for each printhead to a predetermined time limit of inactivity for each printhead;

operating with the controller a third actuator to move each printhead independently to the corresponding printhead receptacle for the printhead when the measured time of inactivity for the printhead equals or exceeds a predetermined maximum time limit of inactivity for the printhead.

18. A printer comprising:

a plurality of printheads;

a capping station for each printhead in the plurality of printheads, each capping station including:

a printhead receptacle having at least one wall configured to enclose a volume, the printhead receptacle having an opening corresponding to a perimeter of the printhead associated with the capping station;

at least two members pivotably mounted to the at least one wall of the printhead receptacle, the members being configured to move between a first position where the at least two members are adjacent of the at least one wall of the printhead receptacle and a second position where the at least two members extend across the volume of the printhead receptacle;

at least two thermoelectric devices, the at least two thermoelectric devices are mounted to the at least two members in a one-to-one correspondence;

a first actuator operatively connected to the at least two members, the first actuator being configured to move the at least two members between the first position and the second position; and a controller operatively connected to the first actuator of each capping station, the controller being configured to operate the first actuator of each capping station to move the at least two members between the first position and the second position and to apply an electrical current to the thermoelectric devices selectively.

19. The printer of claim 18, each member in the at least two members of each capping station further comprising:

a base section made of hydrophobic material; and an ink receiving surface made of hydrophilic material.

20. The printer of claim 19 wherein the at least two members in each capping station extend perpendicularly from the at least one wall of the printhead receptacle in each capping station to extend across the volume of the printhead receptacle when the at least two members are at the second position.

21. The printer of claim 20 wherein each member of the at least two members in each capping station have a same length.

22. The printer of claim 21 wherein the length of each member in the at least two members of each capping station does not enable the at least two members to contact one another when the at least two members are at the second position to form a gap between the at least two members at a center of the opening of the printhead receptacle.

23. The printer of claim 22 wherein each member in the at least two members is sector-shaped.

24. The printer of claim 23 wherein a hydrophilic ink receiving surface is mounted directly to the thermoelectric device on each member in the at least two members.

* * * * *